US005752338A

United States Patent [19]

Lameiras Guede

[11] Patent Number: 5,752,338

[45] Date of Patent: May 19, 1998

[54] SAFETY DEVICE FOR MUZZLE-LOADED RIFLE TRIGGERS

[75] Inventor: Jose Luis Lameiras Guede, Zamudio-Bilbao, Spain

[73] Assignee: Ardesa, S.A., Zamudio-Bilbao, Spain

[21] Appl. No.: 782,532

[22] Filed: Jan. 10, 1997

[30] Foreign Application Priority Data

Jan. 30, 1996 [ES] Spain ..... P 9600206

[51] Int. Cl.[6] ..... F41A 17/00

[52] U.S. Cl. ..... 42/70.06

[58] Field of Search ..... 42/70.06, 66; 89/150

[56] References Cited

U.S. PATENT DOCUMENTS

| | | | |
|---|---|---|---|
| 975,286 | 11/1910 | Ross | 42/70.06 |
| 1,147,659 | 7/1915 | Swebilius | 42/70.06 |
| 1,664,788 | 4/1928 | Oberhammer | 42/70.06 |
| 2,914,877 | 12/1959 | Willenbacher | 42/70.06 |
| 3,024,559 | 3/1962 | Weatherby | 42/70.06 |
| 3,713,242 | 1/1973 | Seifried | 42/70 E |
| 3,715,826 | 2/1973 | Seifried | 42/70 E |
| 4,391,058 | 7/1983 | Casull | 42/69 A |
| 4,569,145 | 2/1986 | Ruger et al. | 42/16 |
| 4,621,445 | 11/1986 | Rohm | 42/66 |
| 4,897,951 | 2/1990 | Osborne | 42/70.06 |

FOREIGN PATENT DOCUMENTS 2245497 3/1974 Germany .

*Primary Examiner*—Charles T. Jordan
*Assistant Examiner*—Meena Chelliah
*Attorney, Agent, or Firm*—Ladas & Parry

[57] ABSTRACT

The safety device consists of a plate (1) with a manually drivable lever (3), the plate lying sideways to and mounted to swing on one of the side faces of the casing of the rifle, the plate (1) being provided on its rear edge with a heel (9) which in one position of the plate (1) lies above the top edge of the trigger (8) without interfering with the operation of the trigger, whereas in the other position, namely the safety position, the heel (9) lies above the top edge of the trigger (8) preventing it from being operated, thereby to serve as a safety device preventing the firearm from being involuntarily fired whilst the device is in the locked trigger (8) position.

3 Claims, 4 Drawing Sheets

SAFETY DEVICE FOR MUZZLE-LOADED RIFLE TRIGGERS

FIELD OF THE INVENTION

The present invention relates to a device designed to lock the relevant trigger in a muzzle-loaded rifle in order to prevent the arm from being accidentally fired, complementing the chamber safety device with which arms of this kind are usually provided, being independent of such chamber, that is to say of the position taken up by the chamber, thereby to double the safety of the arm.

BACKGROUND OF THE INVENTION

Muzzle-loaded rifles usually have a safety position of the chamber preventing the arm from being accidentally fired, which safety position is achieved by sliding back the relevant bolt handle until the latter is set in an opening above the linear notch for driving the actual chamber.

Said handle may nevertheless be ousted from the safety position whilst carrying or handling the arm, resulting in an accident which may be fatal.

In addition to this safety device for position of the chamber, certain rifles have a safety device which locks the trigger independently of the locking of the chamber by the bolt handle.

In this sense, said safety locking device for the trigger is based upon a plate mounted sideways on one side of the mechanism casing and articulated to said casing, and the plate may be driven by means of a lever to take up two positions, one locking and one releasing the trigger.

Despite this safety device preventing, in most cases, the arm from being involuntarily fired if the arm is dropped or involuntarily manipulated, etc., there is no doubt that the device includes a number of internal components that on the one hand render the mechanism extremely complex and on the other prevent the same from being sufficiently efficient, or it may fail precisely because the internal elements of the mechanism, ensuring that the trigger is locked, are concealed and the trigger itself needs to be driven in order to check whether or not it is locked.

SUMMARY OF THE INVENTION

The device proposed herein is based upon a hinged plate driven by a lever, the lever lying sideways to one side of the mechanism casing of the arm, and is designed to lock the operating trigger, albeit overcoming the drawbacks and disadvantages of this kind of conventional device.

More specifically, the device of the invention is characterized in that the plate has a transverse heel on its rear edge that comes to lie behind the mechanism casing and which in one position of the plate allows the trigger to swing whereas in the other position of the plate said rear heel lies above the upper edge of the trigger and prevents said trigger from swinging, thereby preventing the arm from being accidentally fired.

Another feature of the invention is that the plate has a pair of rebates or cavities that work together with a salient or boss from a strip lying sideways thereto to hold both positions, either the lock position or the release position, perfectly stable and almost retained with respect to one another, and hence in order for the device to be locked or unlocked, a slight manual effort must be exerted to remove said salient, clipped into either of the rebates provided to such end in the plate itself.

The limiting positions, i.e. the lock and release positions, are defined because the plate is provided with an elongate opening which defines the maximum travel of the plate itself in either direction, because a pin that is fixed to the actual side surface of the mechanism casing upon which the plate itself is mounted sideways, plays with in said elongate opening, which further defines an arcuate path, the plate being characterized in that the point at which it is hinged lies close to the area where the projection constituting the manually driven lever begins.

The solution which the device described affords is clearly far simpler and more practical and efficient than that afforded by conventional devices, for the device of the invention itself on the one hand allows an external check to be made to see whether or not the trigger is locked, without having to drive the same, which will obviously make the user feel more at ease.

BRIEF DESCRIPTION OF THE DRAWINGS

In order to provide a fuller description and contribute to the complete understanding of the characteristics of this invention, a set of drawings is attached to the specification which, while purely illustrative and not fully comprehensive, shows the following.

DETAILED DESCRIPTION OF A PREFERRED EMBODIMENT OF THE INVENTION

Figure 1:
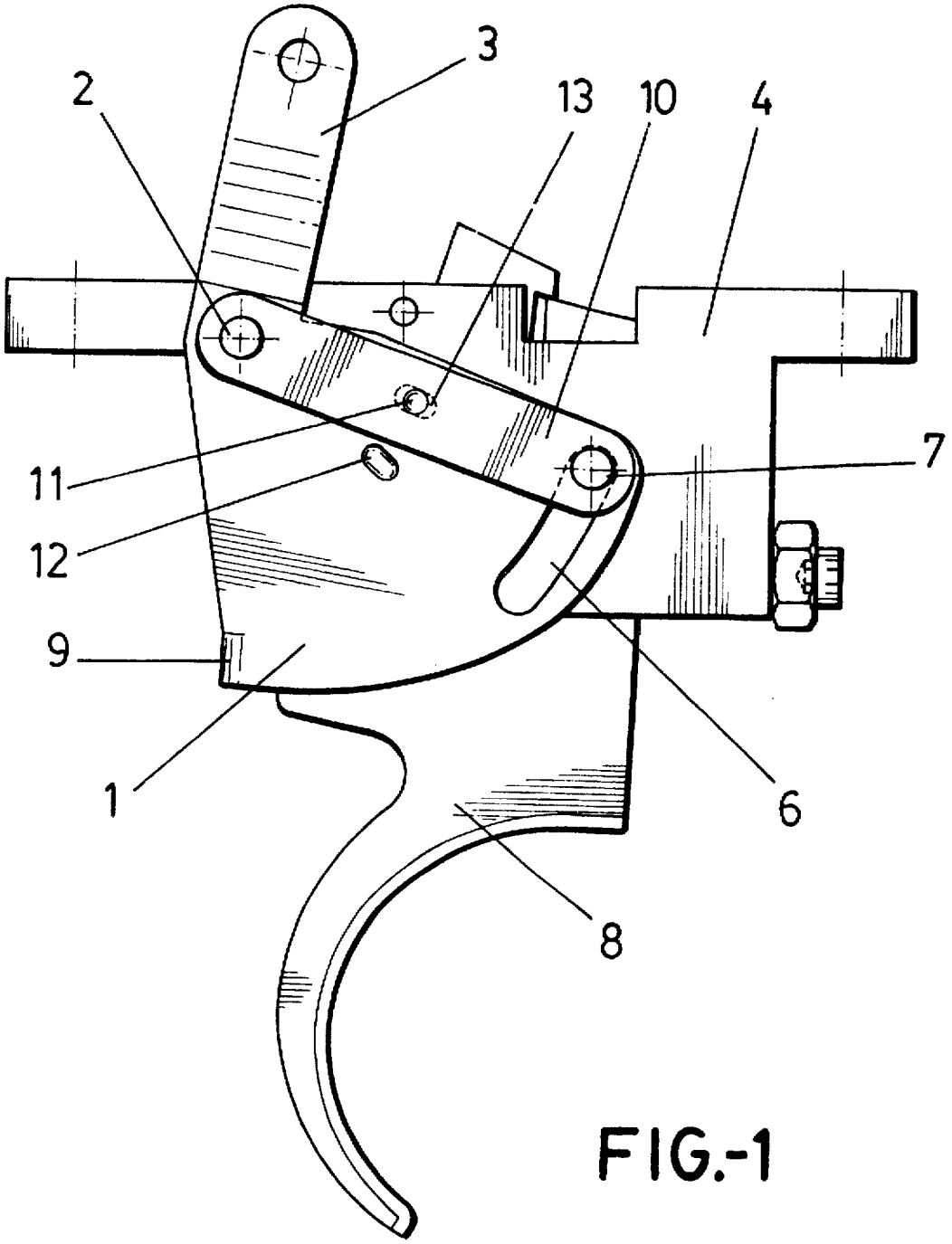
FIG. 1 is a side elevation view of the device of the invention, in a position in which the trigger driven by the arm is released, that is said trigger is freely drivable.
Figure 2:
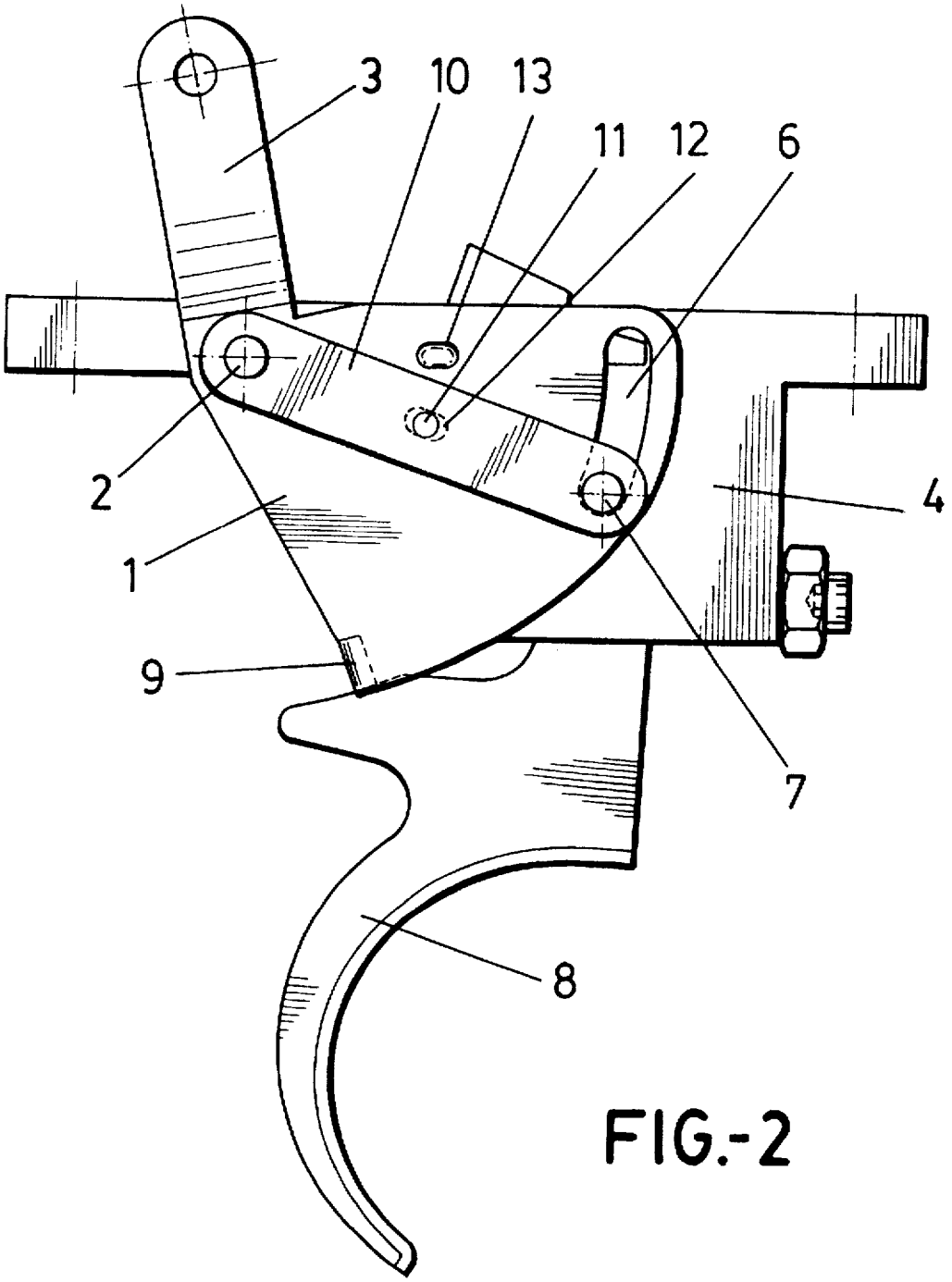
FIG. 2 shows the same device in FIG. 1 in the safety position, that is locking and preventing its trigger from being driven.

With reference to the figures, the device of the invention consists of a plate (1) comprising a circular sector which is mounted to swing about an axis formed by a hinge pin (2) and extends from the area of the hinge pin into a manually drivable lever (3), as will be explained hereinafter. As shown in FIGS. 1 and 2 the lever 3 extends outwardly of plate 1 along a line passing through the axis of hinge pin 2. The plate (1) is mounted sideways on one of the sides of the relevant mechanism casing (4) of the firearm, which has been designated (5) in FIG. 3, i.e. the barrel, the telescopic sight and all other parts lying close to the mechanism casing (4) where the device of the invention is mounted, have been designated (5).

Figure 4:
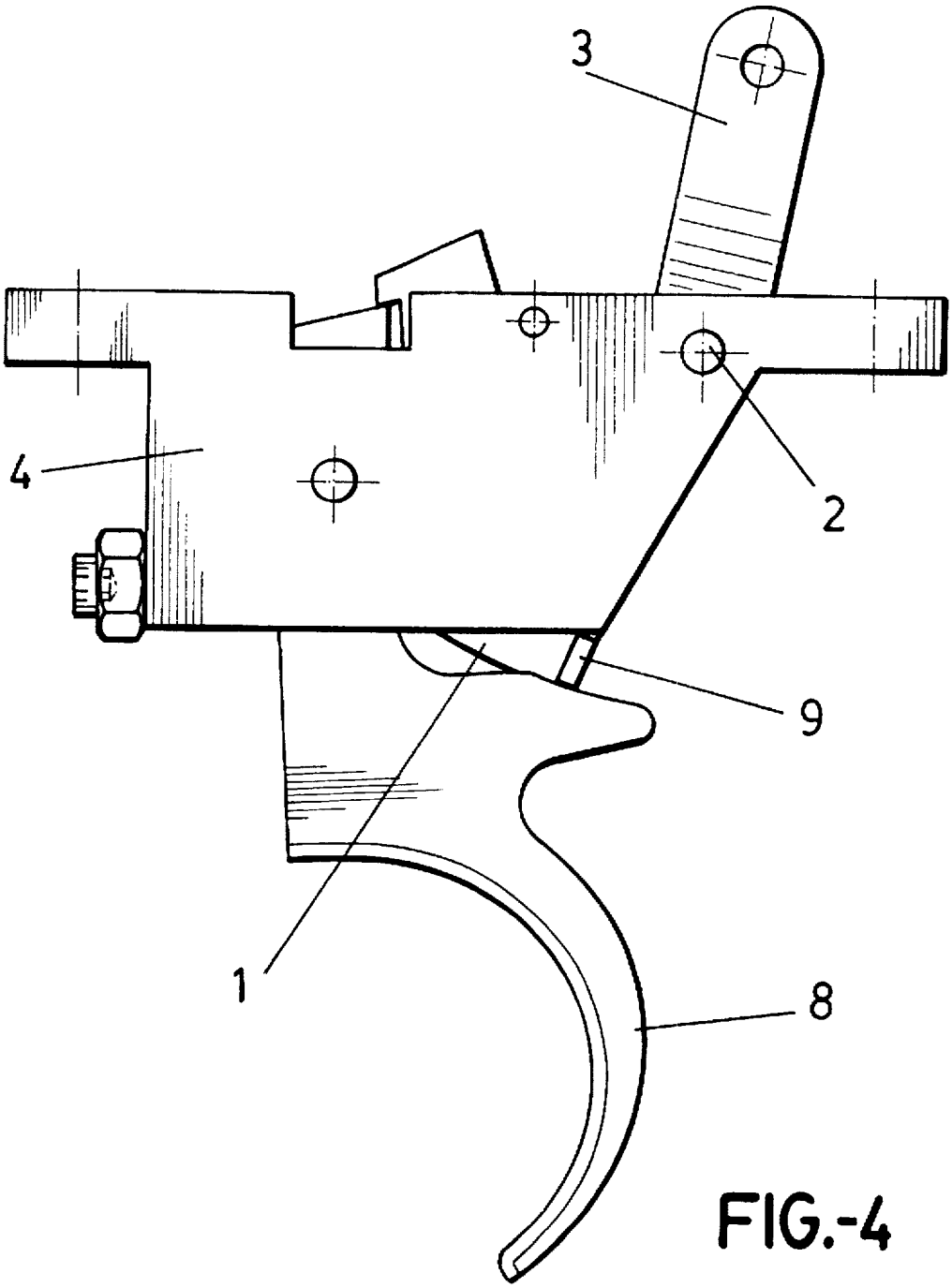
FIG. 4 is finally a rear elevation view of the device shown in FIGS. 1 and 2, with the drive trigger in the locked position or held still.

The plate (1) as an elongate arcuate opening (6) in an area opposite that of the hinge pin (2), with a fixed transverse pin (7) extending in said opening, the ends of the opening (6) marking the limits of maximum travel or angular swivel of the plate (1). The position shown in FIG. 1 is the position in which the trigger (8) is released, whereas the position shown in FIG. 2 is the position in which said trigger is locked, the foregoing being achieved because the plate (1) is provided at its rear edge with a transverse heel (9) that comes to lie, in the position shown in FIG. 1, beyond the reach of the trigger (8) when the trigger is driven, whereas in the position shown in FIG. 2, said heel (9) comes to lie above the top edge of said trigger (8), interfering with the latter and preventing it from being pulled back, i.e. preventing said trigger (8) from being driven as shown in FIGS. 2 and 4.

A narrow strip (10) is mounted between the hinge pin (2) of the plate (1) and the pin (7) overlying the plate (1) itself which strip (10) is provided with an inner side boss-like salient (11) which may be clipped into one of two cavities or rebates (12) and (13) provided in the plate (1) on its side opposite said strip (10).

In the position shown in FIG. 1, the trigger (8) may be pulled, as aforesaid, since the heel (9) on the plate (1) does not interfere with the trigger swinging, the position being one in which the pin (7) is located at the top end of the elongate opening (6).

Now, if the lever (3) attached to the plate (1) is manually driven, to swing the plate about the hinge pin (2) and take up the position shown in FIG. 2, in which the pin (7) will lie in the extreme position facing the elongate opening (6), and the heel (9) will come to lie above the trigger (8), specifically above its top edge, thereby preventing the trigger (8) from swinging if an attempt is made to intentionally or unintentionally pull the trigger, serving thus as a safety device preventing said trigger (8) from being involuntarily or even voluntarily pulled unless the lever (8) is again driven to move the plate (1) to the position in FIG. 1, in which the trigger (8) is released.

In the released position, i.e. in the position in which the trigger (8) may be driven, the plate (1) is engaged with the boss (11) on the strip (10) a via the rebate or cavity (13) in the plate (1). The lever (3) must be slightly manually driven in order to release this stable position, whereas in the position of FIG. 2, i.e. with the trigger (8) locked, then the boss or appendix (11) on the strip (10) housed in the cavity or rebate (12) of plate (1), the engagement is stable and a new effort is required on the lever (3) to change the position of the plate (1).

The device thus constructed is very simple both in structure and operation and its configuration makes it absolutely impossible for the trigger (8) to be pulled in the safety position, because as shown in FIG. 2, the lock heel (9) will prevent this, therefore providing the arm, in which said device is applied, with an enhanced safety mechanism relative to that afforded by conventional arms.

The pin (7) functions as a hinge pin for the trigger (8) and the trigger is biased by a recuperator spring (14).

Figure 3:
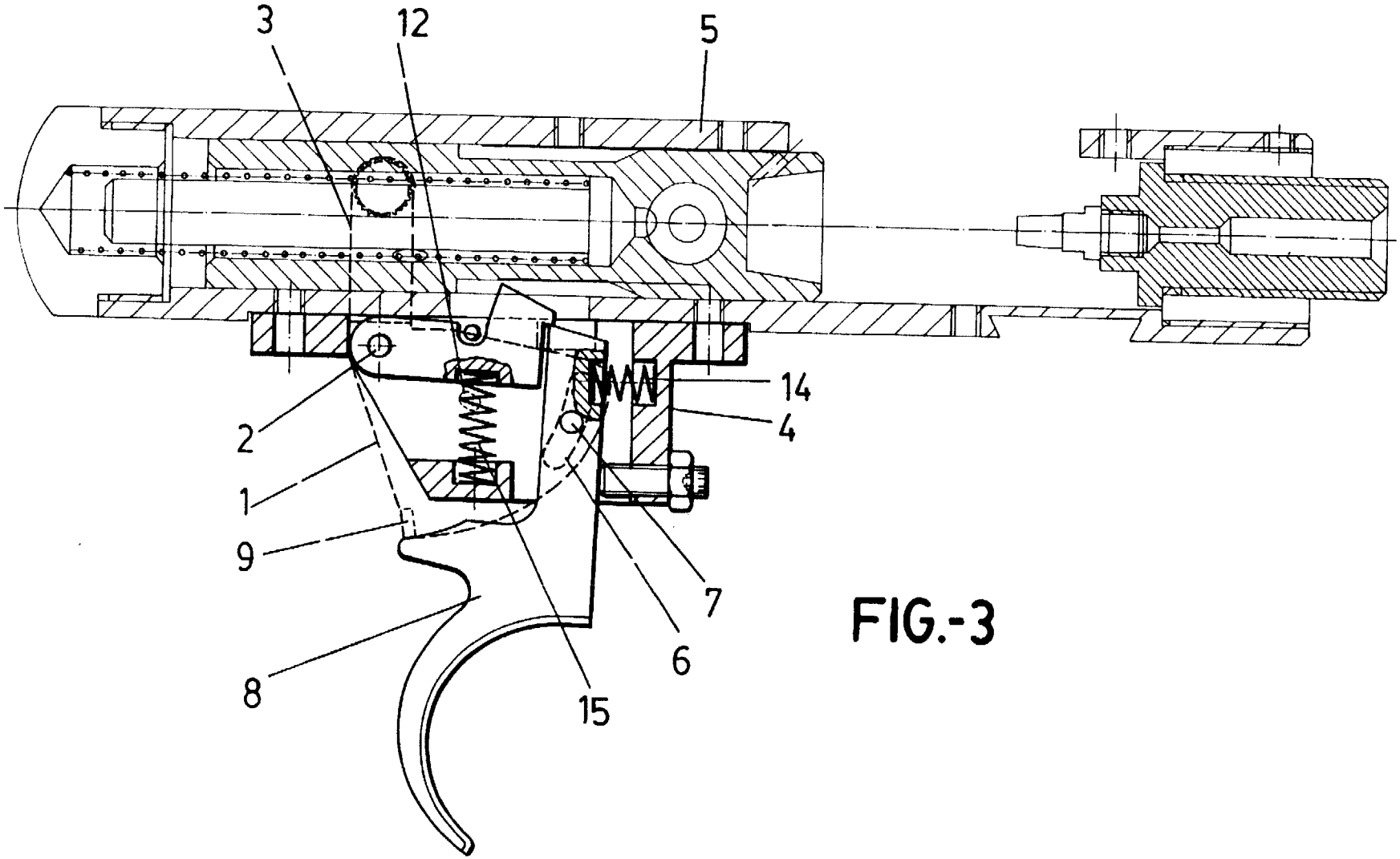
FIG. 3 is a side view of the device shown in the above figures, applied to the barrel portion of a firearm consisting of a muzzle-loaded rifle.

A spring (15) shown in FIG. 3 engages a top part, which is articulated about the hinge pin (2), to cause it to spring back, when it is released when the trigger (8) is pulled.

What is claimed is:

1. A safety device for a trigger of a muzzle-loaded firearm, the firearm having a casing from which the trigger extends for being pivotably moved from an inoperative position to an operative position, said safety device comprising:

a plate pivotably mounted laterally at a side of the casing of the firearm and visible at the side of the firearm, said plate being pivotably movable between a first position in which the trigger is blocked from being moved to its operative position and a second position in which the trigger is released for movement to its operative position, said plate including an engaging lever to pivotably move said plate between its first and second positions, said plate having an elongate slot in which is slidably engaged a fixed pin extending from said casing of the firearm, said plate having a rear edge with a transverse heel thereat positioned to engage said trigger when the plate is in said first position thereof to block movement of the trigger whereas in said second position of the plate, said heel is displaced away from said trigger and said trigger is released for movement to its operative position, said heel being positioned on said plate to engage a top edge of said trigger to block movement thereof when said plate is in said first position.

2. A safety device as claimed in claim 1, comprising a hinge pin on said casing of the firearm, said plate being connected to said hinge pin for its pivotal movement between said first and second positions thereof, said engaging lever extending from said plate proximate said hinge pin, a strip connected to said hinge pin and to said fixed pin, said strip including a boss facing said plate, said plate having two cavities in which said boss is respectively and releasably engaged to establish said first and second positions of the plate.

3. A safety device as claimed in claim 2, wherein said lever extends outwardly of said plate along a line passing through an axis of said hinge pin.

* * * * *